United States Patent [19]

Biggar, III

[11] 4,095,498

[45] Jun. 20, 1978

[54] DIECUTTER

[75] Inventor: Frank McKay Biggar, III, Angola, N.Y.

[73] Assignee: Frank M. Biggar, Jr., Hamburg, N.Y.

[21] Appl. No.: 695,838

[22] Filed: Jun. 14, 1976

[51] Int. Cl.[2] ..... B26D 1/56

[52] U.S. Cl. ..... 83/346; 83/7; 83/12; 83/347

[58] Field of Search ..... 83/7, 12, 346, 347, 83/1

[56] References Cited

U.S. PATENT DOCUMENTS

| | | | |
|---|---|---|---|
| 3,348,477 | 10/1967 | Taylor et al. | 83/347 |
| 3,826,165 | 7/1974 | Currie et al. | 83/346 |
| 3,850,059 | 11/1974 | Kang | 83/12 |
| 3,866,497 | 2/1975 | Wolfberg | 83/346 |
| 3,872,752 | 3/1975 | Remde et al. | 83/346 |

*Primary Examiner*—Donald R. Schran
*Attorney, Agent, or Firm*—Rogers, Eilers & Howell

[57] ABSTRACT

A diecutting apparatus is disclosed which accepts interchangeable die cylinders of a variety of lengths and diameters. Rapid replacement, adjustment and reversal of the die is possible. The station has a support bar for mounting the die cylinder and a slidable support for the die cylinder bearing blocks. The bearing blocks slide horizontally along the support bar to accept die cylinders of a variety of lengths. The support bar is mounted at each end on transverse slides which slide vertically to accept die cylinders of a variety of diameters. Mounted above the die cylinder support bar is a support slide on which are mounted contact rollers and pressure cylinders for applying a biasing force to the die cylinder. The slides may be fixed in place for each particular die cylinder used. The pressure cylinders and contact rollers act on bearing surfaces on the die cylinder.

13 Claims, 7 Drawing Figures

DIECUTTER

BACKGROUND AND SUMMARY OF THE INVENTION

Rotary diecutting of web paper products, e.g., to form adhesive labels, is disclosed in U.S. Pat. No. 3,850,059, the disclosure of which is incorporated by reference herein. In diecutting adhesive labels, continuous webs of label material bearing a pressure sensitive adhesive and adhered to a substrate of strippable material is cut while passing through the nip of a rotating die and an anvil or pressure roll. The particular shape or pattern of the label is determined by the shape of the die. The labels are recovered by stripping away the undesired portion of the label material.

Rotary diecutters are expensive pieces of equipment and operate at high speeds and produce large quantities of product in a given time. As a consequence, the dies wear quite rapidly, particularly at their leading edge, and during long runs may require changing, resulting in down time. In addition, it is desirable to use a variety of web sizes and die sizes on the same equipment. Dies of widely differing diameters may be required for different jobs and it may be necessary to process paper webs of varying widths. This necessitates that the diecutting station equipment be equipped to handle varieties of die sizes and paper web widths with equal effectiveness for efficiency and economy.

Diecutting stations which can accommodate different dies are known. It is also known in rotary cutting to apply force to the die to achieve enough contact between the die and the workpiece. U.S. Pat. Nos. 3,491,641 and 3,826,165, the disclosures of which are incorporated by reference herein, disclose typical structures.

Applicant's diecutting structure does not place downward force on the cutting edges of the die except during cutting, thereby extending the life of the die. The die does not place a downward force on the work piece except through the die itself, so the workpiece is not unduly hindered in its travel through the diecutting station. The downward force on the die and diecutting surface is adjustable to insure a continuous cut of good quality throughout the run of the die with a variety of die sizes.

Adjustments and changes in applicant's structure can be made very rapidly with very little time lost through downtime during changeovers or repair. The structure readily accepts dies of different diameters and lengths and will operate on a variety of web widths without major changes in the diecutting station.

The placement of the dies in the diecutting station is readily reversible to allow for longer use of a particular die by getting the maximum cutting from both the front and back edges of the die. The differential wear in the front and back of the die can be accommodated. In many instances this can save the cost of an additional die for a given run or can save the cost of a die of a more expensive design.

The bearings for the die cylinder are free floating, no downward force is applied through the bearings to hold the die in contact with the workpiece, extending the bearing life. The force to the die and die cutting edges is applied close to the diecutting edges so that bending moments along the die cylinder and supporting shafts are reduced. Loads on the die cylinder, die, and other components are supported close to the frame of the machine to minimize stress.

DESCRIPTION OF THE PREFERRED EMBODIMENT

Figure 1:
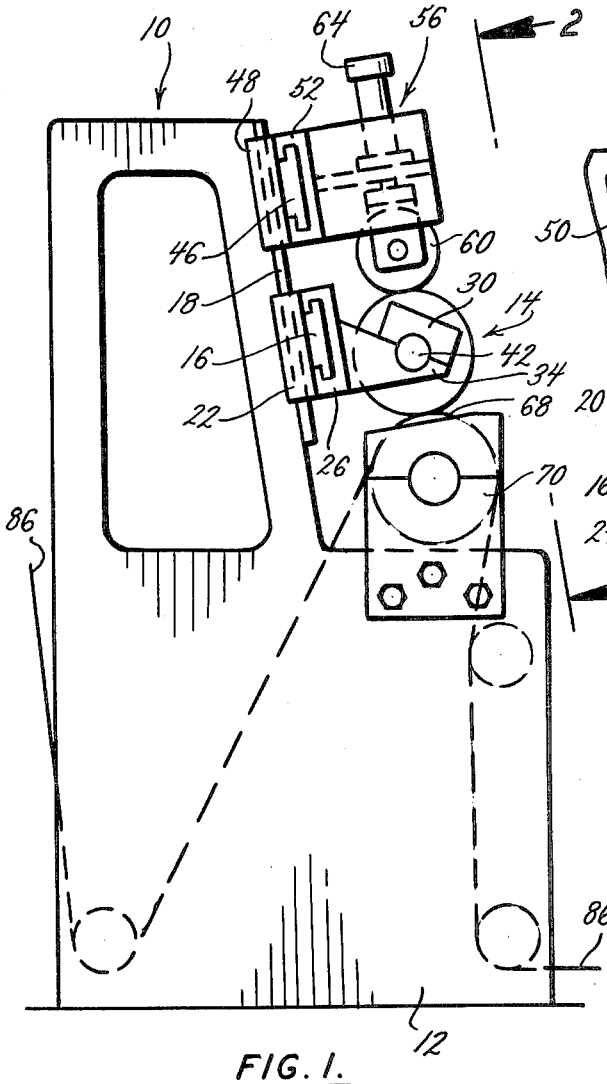
FIG. 1 is a partial side view of a diecutting station using the structure of the invention.
Figure 4:
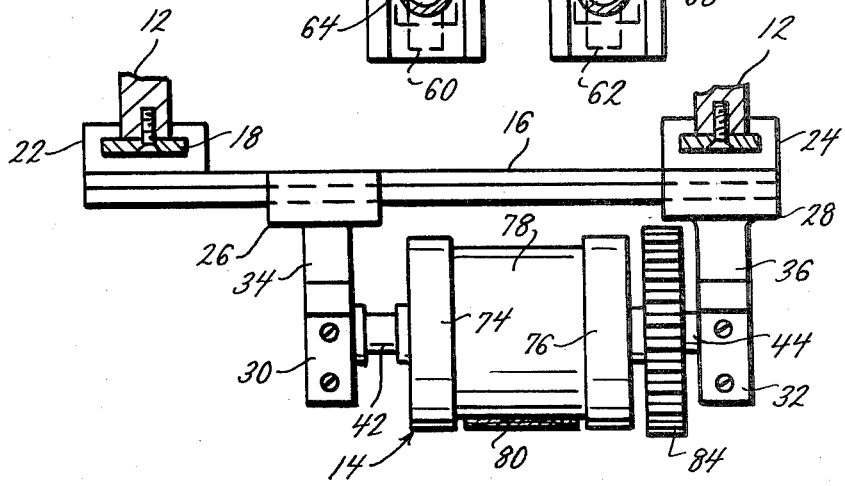
FIG. 4 is a sectional view taken along the plane of line 4—4 in FIG. 2.

Referring in more detail to the drawings, FIG. 1 shows a diecutting station 10 with a frame 12 in which is mounted a cylindrical die 14. Die 14 is mounted on a cross bar 16 which is positioned between a pair of uprights 18 and 20, which are part of frame 12, and extend upwardly therefrom. Cross bar 16 is mounted in receiving blocks 22 and 24 on uprights 18 and 20. Receiving blocks 22 and 24 have a c-shaped cross section, as shown in FIG. 4, which cooperate with uprights 18 and 20. The receiving blocks 22 and 24 are freely slidable in the vertical direction along uprights 18 and 20. Attached cross bar 16 mounted on receiving blocks 22 and 24 is freely slidable with receiving blocks 22 and 24.

Figure 5:
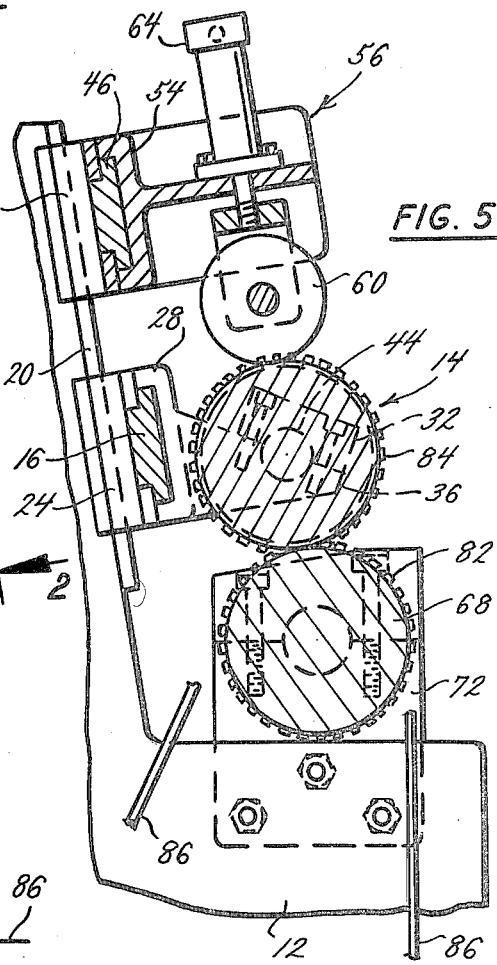
FIG. 5 is a sectional view taken along the plane of line 5—5 in FIG. 2.
Figure 6:
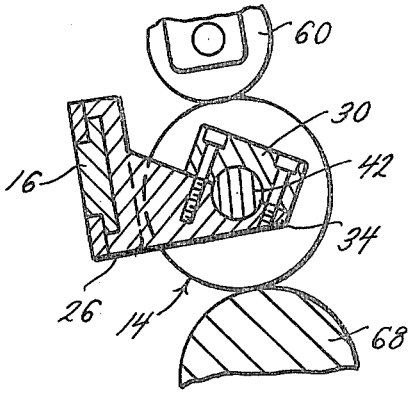
FIG. 6 is a partial sectional view taken along the plane of line 6—6 of FIG. 1.
Figure 2:
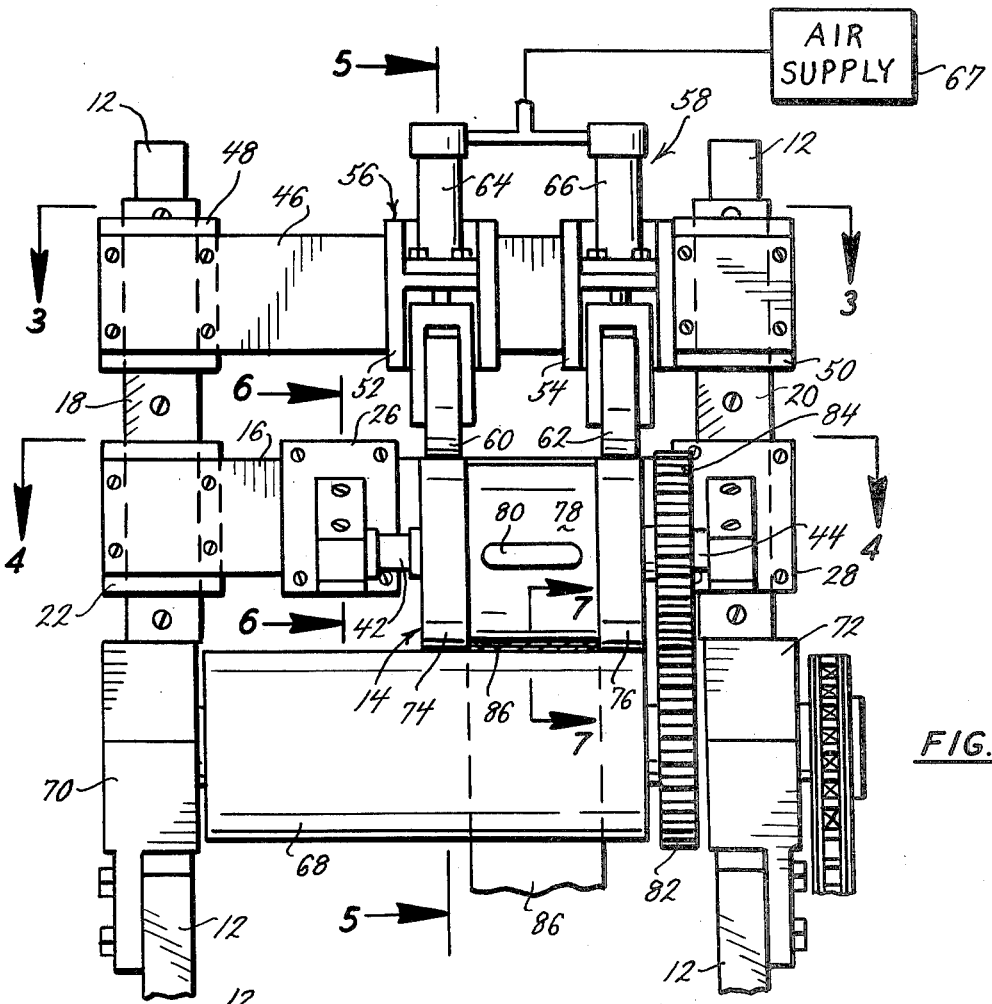
FIG. 2 is a partial front view of the diecutting station shown taken along line 2—2 in FIG. 1.
Figure 3:
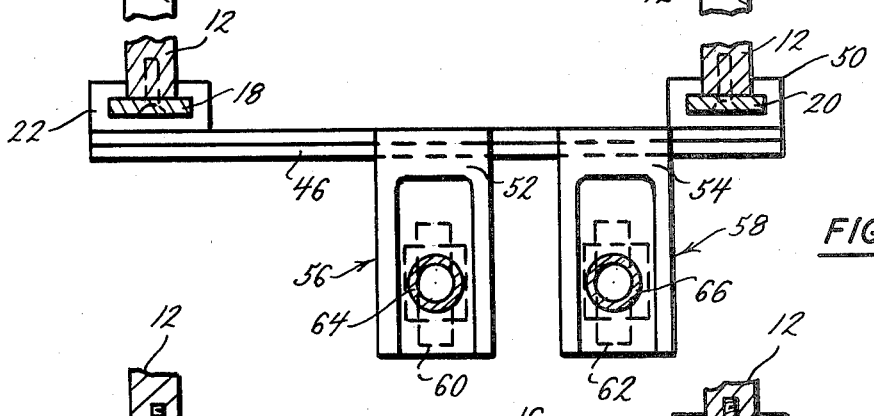
FIG. 3 is a partial sectional view taken along the plane of line 3—3 of FIG. 2.

Supported on cross bar 16 are two bearing blocks 26 and 28, shown in FIGS. 1 and 2. Bearing block 28 can be formed as a unitary part fixed to receiving block 24, as shown. Bearing block 28 can also be a separate sliding part, if desired. Bearing block 26 is freely slidable in a horizontal direction along cross bar 16. Bearing block supports 26 and 28 are split and have removable caps 30 and 32, as shown in FIGS. 4, 5 and 6. The bearing blocks 26, 28 support the bearings 34, 36 on the ends of shafts 42 and 44 of the diecutting cylinder 14.

Above cross bar 16 is a second cross bar 46 which is similar in design and cross section to cross bar 16 and is also mounted on receiving blocks 48 and 50, which are shown fixed on vertical supports 18 and 20, but could be movable, if desired. Slidably received on cross bar 46 are support blocks 52 and 54 which slide horizontally along cross bar 46. Mounted on each of blocks 52 and 54 is a pressure wheel assembly 56, 58. Assemblies 56, 58 have smooth machined wheels 60, 62 of steel or similar smooth hard material, which can be reciprocated in a vertical direction by double acting an air supply hydro-pneumatic cylinders 64, 66. The cylinders are operated by an air supply 67. Slidable supports 26, 28, 52 and 54 can be locked in any chosen position by set screws, bolts, pins, cams or any other conventional latch, if desired.

An anvil or pressure cylinder 68 is mounted below die cylinder 14 in bearings 70, 72, which may be split, as shown, or which may be solid and removable from the frame 12 with anvil cylinder 68. Die cylinder 14 contacts pressure cylinder 68 at circumferential lands 74, 76 which are higher than the central portion 78 of the die cylinder. Typically, there is a clearance of approximately 0.002 inches between portion 78 and the pressure cylinder 68, or less than the thickness of the workpiece, depending on the thickness of the carrier sheet. A clearance of 0.002 inches is normally used where the carrier sheet is 0.003 inches thick, a normal thickness. Clearance can be greater or less depending on the particular job, as is known in the art. Mounted on portion 78 of die cylinder 14 is a die 80 which may be a machined die, a chemically milled die or other types as is known in the art. The die extends outwardly beyond the profile of portion 78 of the die cylinder. There is a slight clearance between the die and the pressure cylinder to avoid cutting entirely through the web 86 being processed, as is known in the art.

The gear train 82, 84, a chain drive, timing belt or other conventional mechanism which rotates the anvil 68, the diecutting cylinder 14 and drives the web or workpiece 86 in a manner known in the art.

OPERATION OF THE DEVICE

Figure 7:
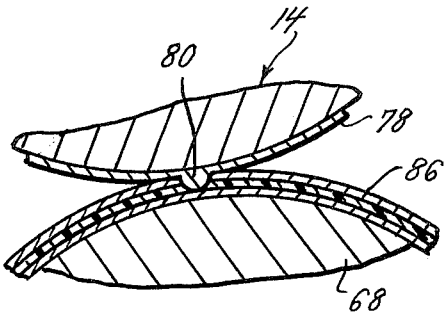
FIG. 7 is a broken view of the die cylinder and anvil showing the workpiece being contacted by the die.

In operation of the device a traveling web of paper such as the multi-laminar web 86 passes between the nip of the anvil 68 and the die cylinder 14 as shown in FIG. 7. The land portions 74, 76 are in direct contact with anvil 68. The web 86 passes between lands 74, 76 and is contacted by die 80 which cuts partially through the multiple layers of paper, as shown. Horizontally fixed support 24 and other latches, if used, prevent horizontal movement of die cylinder 14. Pressure assemblies 56 and 58 are positioned over lands 74, 76 of die cylinder 14 with pressure wheels 60 and 62 in contact therewith, as shown.

Mounts 52, 54 are also fixed to prevent horizontal movement.

The cylinders 64, 66 are shown as hydro-pneumatic cylinders, but can be vacuum-hydraulic cylinders, mechanical screws, or other comparable devices. Cylinders 64, 66 are preferably of the double acting type so that the pressure wheels are extended during diecutting to contact and apply force to the lands 74, 76 of die roller 14 and are later withdrawn when the pressure circuit is reversed. This system is particularly advantageous where the process is interrupted, e.g., by a broken web. The cylinders can be retracted, the machine rethreaded and the cylinders reengaged without readjusting the pressure setting. The cylinders 64, 66, through lands 74, 76, apply force to the die 80 in contact with workpiece 86. Normally the total force supplied is from about 2,500 to 3,000 pounds force. This is usually about 100 to 200 pounds force per lineal inch of the cutting edge of die 80.

As die 80 becomes blunter with use, the force applied by cylinders 64, 66 can be increased, to insure a proper cutting.

The edges of a die 80 may wear unevenly depending on the type of die being used and the type of stock being cut. Most often the trailing edge of the die wears at a slower rate than the leading edge of the die. A good machine die may cost 1,500 to 4,000 dollars for a die and a chemically milled die suitable for short runs might cost 400 dollars. It is preferable to get as much useful life out of a die as possible, for economy and convenience. If one edge of the die has become worn to the point when a switch would be desirable to extend the life of the run or the die, it is only necessary to retract cylinders 64, 66 to remove the pressure rollers 56, 58 from contact with lands 74, 76 of die cylinder 14, remove the split bearing caps 34, 36, switch gear 84 to the opposite end of cylinder 14, switch the ends of cylinder 14 and replace bearing caps 34, 36. Cylinders 64, 66, can then be repressurized and operation continued. An entirely new die cylinder 14 can be added or replaced by similar process.

If the die cylinder is to be of a different size, for processing a wider or narrower web, for example, the bearing block receiver 26 can be moved horizontally left or right to accommodate the length of the cylinder when it is placed in the bearing blocks 30, 32. Pressure cylinders 64 and 66 can also be positioned so that they are symetrically located on the cylinder 14 of any size by sliding them horizontally to the proper location and then fixing the carriers 52, 54 in position by set screws or other means. This loading technique has the advantage of applying the downward force symetrically to the die cylinder so that the load on the die is evenly distributed.

With some die cylinder sizes it may also be necessary or desirable to replace the anvil or pressure roll 68 to accomodate the particular diameter of the die cylinder. A large diameter die cylinder may be needed for long repetitive patterns. A smaller anvil 68 might be used with a larger die cylinder. The anvil 68 can be readily replaced by opening the split bearing blocks 70, 72, removing anvil 68, positioning a new anvil in the blocks and closing the split bearing blocks 70, 72, or by removing the bearing blocks 70, 72 from the frame with anvil 68 and positioning a new anvil and bearing blocks in frame 12.

The pressure cylinders 64, 66 can have pistons which have a substantial travel so that cutting die cylinders of a variety of diameters may be accomodated in the device without moving the horizontal support 46 vertically. This has some advantages since the horizontal support 46 may be fixed to the frame of the machine and it eliminates the necessity of stop mechanisms of high strength to support the support bar 46. However, support 46 could be made vertically adjustable if desired.

Registration of the die may be made laterally adjustable, if desired. A screw adjustment may be provided to laterally shift the bearing blocks 30, 32. This adjustment could be made while the machine was operating.

It will be appreciated by those skilled in the art that the present invention may be used without using the exact embodiments disclosed herein for purposes of illustration. Various modifications may be used in the specific structure disclosed herewith without departing from the spirit of the invention disclosed. The invention is to be limited only by the scope of the claims appended hereto.

I claim:

1. In a rotary diecutting device for diecutting traveling web having a frame, a rotating diecutting cylinder mounted in bearings in the frame for supporting a die, a rotating anvil cylinder mounted in bearings in the frame and means to receive a web between the cylinders, the improvement comprising adjustable means in the frame to apply force to urge the diecutting cylinder into contact with the anvil cylinder, the diecutting cylinder having a die accepting location thereon and means thereon spaced from the die accepting location cooperating with the means to apply force to the diecutting cylinder; independently selective means to receive individual anvil cylinders and individual diecutting cylinders of a plurality of diameters; means to selectively receive diecutting cylinders of a plurality of preselected lengths; and including means to adjust the relative distance between individual bearings in the frame.

2. The device of claim 1 wherein the anvil cylinder is mounted in bearings having means for removing the anvil for reversing, replacing and servicing of a preselected anvil cylinder.

3. The device of claim 1 wherein the die cylinder is mounted in axially split bearing means for splitting the bearings for reversing, removing, replacing and servicing of a preselected die cylinder.

4. The device of claim 1 wherein the device has horizontally adjustable means for receiving and supporting a die cylinder of a preselected length.

5. The device of claim 4 wherein the horizontally adjustable means has means to fix the position in the device of a preselected die cylinder.

6. The device of claim 1, wherein the device has vertically adjustable means for receiving and supporting a die cylinder of a preselected diameter.

7. The device of claim 1 wherein the means to apply force to the diecutting cylinder is placed above the diecutting cylinder.

8. The device of claim 7 wherein the means cooperating with the means to apply force to the diecutting cylinder is positioned symmetrically about the location of a die.

9. A rotary diecutting device for diecutting a traveling web having a frame, removable bearing means in a lower portion of the frame for mounting a preselected rotatable anvil cylinder, vertical means in the frame extending upwardly from the location of the anvil cylinder, including means for receiving vertically slidable brackets and vertically slidable brackets mounted thereon, a first horizontal cross bar mounted on the vertically slidable brackets for vertical movement along the upwardly extending means, means on the first cross bar receiving a horizontally slidable bracket on the first cross bar and a horizontally slidable bracket mounted thereon, a second horizontal cross bar having means for receiving a horizontally slidable bracket and a horizontally slidable bracket mounted thereon, the second cross bar being fixedly mounted above the first cross bar, the first horizontal cross bar also having a fixed support means thereon, the horizontally slidable bracket on the first cross bar and the fixed support means having split cap bearing blocks mounted thereon, the split cap bearing blocks having means to selectively receive bearing shafts of preselected diecutting cylinders, a preselected diecutting cylinder mounted in the split cap bearing blocks having cylindrical land portions symmetrically disposed circumferentially about a central location for mounting a cutting die, the central location being relieved and of a lesser diameter than the land portions and spaced inwardly therefrom, the horizontally slidable bracket on the second cross bar having means to be positioned at preselected locations along the second cross bar and having an actuatable piston and wheel means mounted thereon, the wheels being responsive to actuation of the cylinders to engage the land portions of the below mounted die cylinder to apply force to the land portions of the die cylinder, the horizontally slidable brackets on the first and second cross bars and the cooperating piston and wheel means being adapted to be adjusted to preselected horizontal locations on the first and second cross bars to receive a plurality of lengths of diecutting cylinders having lands at a variety of preselected positions on the diecutting cylinders, and the wheel and piston means and the first cross bar being adapted to be adjusted to a plurality of preselected vertical locations to receive a plurality of diameters of preselected anvils and diecutting cylinders whereby a variety of die combinations of diameters, lengths, locations of land positions and locations of dies may be used in the device.

10. The device of claim 1 wherein the anvil cylinder is mounted in bearings having means for removing the anvil for reversing, replacing and servicing of a preselected anvil cylinder.

11. The device of claim 1 wherein the die cylinder is mounted in axially split bearing means for reversing, removing, replacing and servicing of a preselected die cylinder.

12. The device of claim 1 wherein the device has horizontally adjustable means for receiving and supporting a die cylinder of a preselected length.

13. The device of claim 12 wherein the horizontally adjustable means has means to fix the position in the device of a preselected die cylinder.

* * * * *